United States Patent [19]

Albert

[11] 4,186,842

[45] Feb. 5, 1980

[54] DISPOSABLE DRINKING CUP WITH VALVED LID

[75] Inventor: Kenneth J. Albert, Beverly Hills, Calif.

[73] Assignee: Inventor's Inc., Los Angeles, Calif.

[21] Appl. No.: 845,898

[22] Filed: Oct. 27, 1977

[51] Int. Cl.[2] ..... A47G 19/22

[52] U.S. Cl. ..... 220/206; 220/90.4; 220/306; 222/511

[58] Field of Search ..... 220/90.2, 90.4, 90.6, 220/206, 268, 373, 306; 222/485, 511; 215/311

[56] References Cited

U.S. PATENT DOCUMENTS

| | | | |
|---|---|---|---|
| 2,003,657 | 6/1935 | Stubblefield | 215/309 |
| 2,738,090 | 3/1956 | Davis | 229/7 R |
| 3,048,317 | 8/1962 | Cochrane et al. | 229/7 S |
| 3,227,304 | 1/1966 | Asbury | 220/268 |
| 3,262,611 | 7/1966 | Palmer | 220/268 |
| 3,730,399 | 5/1973 | Dibrell et al. | 220/90.4 |
| 3,797,696 | 3/1974 | Dibrell | 220/90.4 |
| 3,905,512 | 9/1975 | Albert et al. | 220/90.4 |
| 4,081,103 | 3/1978 | Zoellick | 220/268 |

*Primary Examiner*—Allan N. Shoap
*Attorney, Agent, or Firm*—Don J. Flickinger

[57] ABSTRACT

A frusto-conical drinking cup which is open at the top and a lid which is removably attached thereto by a "snap" connection. The lid comprises a top wall and an annular skirt depending therefrom. This lid is of a flexible plastic having the property of elasticity to a high degree. It is formed with a slit in close proximity to its periphery and cut on the bias to provide a drinking opening when the lid material is depressed. It is also formed with a straight slit at a site diametrically opposite to the drinking opening and spaced inwardly from the periphery a greater distance than the drinking valve opening. This lid provides a relief valve when the lid is depressed. The lid is fairly thin and is formed with a generally circular reinforcing rib spaced from its periphery and another reinforcing rib between the slit and arranged diametrically of the lid.

4 Claims, 6 Drawing Figures

DISPOSABLE DRINKING CUP WITH VALVED LID

The present invention relates to disposable drinking cups and the lids therefor and is concerned primarily with the lid having two slits providing valve openings. One of these slits is adjacent to the periphery of the lid and provides a drinking opening. The other slit is diametrically opposite to the drinking opening and, when the lid is depressed, provides a relief valve.

BACKGROUND OF THE INVENTION

At the present time, disposable drinking cups are in wide-spread use in fast food restaurants, soda fountains, delicatessen stores and similar establishments and are used to contain a beverage, either hot or cold, which is carried away by the customer. With rare exceptions, the hot beverage is usually coffee or tea and generates steam, and the cold beverage is usually carbonated and creates a gas.

A lid is ordinarily provided to close the open top of the drinking cup with a snap fit. It has been proposed to provide such a lid with a drinking opening adjacent to its periphery and which is opened by a person desirous of drinking from the cup. A valve ordinarily maintains this drinking opening closed. However, when a person opens the valve to drink the contents of the cup, steam or gas will escape through the opening and cause extreme discomfort to the user.

The present invention is founded on the belief that a relief valve in the top wall of the lid which is spaced from the drinking opening will greatly enhance the desirability of the lid in that as it is opened at the same time or slightly before the valve for the drinking opening is opened, it thus permits the escape of steam or gas therethrough.

The closest approach in the known art to a disposable drinking cup and lid of this type is disclosed in U.S. Pat. No. 3,905,512.

There are certain decanters which are not intended to be disposable; that is, discarded after one use, which provide a drinking opening and valve therefor in the top wall of the lid and a relief valve in a skirt depending from the top wall. However, these known devices include mechanism that is highly complicated in providing for opening of the relief valve before opening of the drinking opening. Drinking cups and lids of this decanter type are highly expensive as compared to the drinking cups and lids which are discarded after each use.

With the foregoing conditions in mind, the present invention has in view the following objectives:

1. To provide a drinking cup having an open top and a lid therefor including a top wall and a skirt depending therefrom, with the top wall having diametrically opposed drinking and relief valve openings.

2. To provide a drinking cup and valved lid of the type noted in which the drinking cup is of polystyrene beads which are expanded and molded by heat. This cup tapers downwardly from the edge defining the open top and thus is of a frusto-conical shape.

3. To provide, in a drinking cup and valved lid of the character aforesaid, a skirt having a downwardly opening peripheral groove which receives the upper edge portion of the cup with a snap fit.

4. To provide, in a drinking cup and valved lid of the kind noted, a lid which is made of a polystyrene sheet which is thin, flexible, and elastic to a high degree.

5. To provide, in a drinking cup and valved lid of the type described, a slit in the top wall of the lid which is arcuately shaped as a portion of a frusto-conical surface to provide a drinking opening and a valve member therefor which normally closes the opening, said slit being in close proximity to the periphery of the lid.

6. To provide, in a drinking cup and valved lid of the character aforesaid, a second arcuate slit which is spaced from the periphery of the lid a greater distance than is the arcuate slit for the drinking opening and is shaped as a portion of a cylinder; is in diametric alignment with said drinking opening slit; and is a straight cut. This slit provides a relief opening and a valve therefor.

7. To provide, in a drinking cup and valved lid of the kind described, a reinforcing rib projecting upwardly from the lid, of generally circular shape, and spaced from the periphery of the top wall.

8. To provide, in a drinking cup and valved lid of the type noted, a straight rib extending between said slits and arranged diametrically of the lid. This rib upstands from the material of the lid and accommodates deflection of the lid when force is applied to the top wall centrally thereof.

Various other more detailed objects and advantages of the invention such as arise in connection with carrying out the above-noted ideas in a practical embodiment will in part become apparent and in part be hereinafter stated as the description of the invention proceeds.

SUMMARY OF THE INVENTION

A disposable drinking cup and valved lid therefor comprises a frusto-conical drinking cup of polystyrene made from beads which are expanded and molded by heat. This cup has an open top and is formed with an annular bead immediately adjacent thereto constituting one element of a snap connection.

The lid is of sheet polystyrene and comprises a circular top wall and an annular skirt depending therefrom and having a downwardly opening annular peripheral groove which receives the bead on the cup with a snap fit, and which is of course detachable.

The top wall is formed with an arcuate slit which is in the shape of a portion of a frusto-conical surface in close proximity to the periphery of the lid and this slit provides both a drinking opening and a resilient valve member which normally closes the opening but which may be moved downwardly to a position opening the valve opening as by pressure being applied to the top wall centrally thereof.

Another arcuate slit of smaller dimensions than the drinking opening slit is formed in the top wall and spaced from its periphery a greater distance than is the drinking opening slit. It is shaped as a portion of a cylinder. Both of these slits are in diametric alignment. This last-mentioned slit is formed by a straight cut and provides a resilient relief opening and a valve member therefor which is moved into a position opening the relief opening when the top wall is depressed.

A reinforcing rib upstands from the top wall, is generally circular, and spaced from the periphery of the top wall, but is interrupted to accommodate the drinking opening slit. Also upstanding from the top wall is another rib that extends between said slits and is arranged diametrically of the top wall. This rib presents side walls which accommodate deflection of the top wall when pressure is applied thereto centrally thereof and which deflection would in the absence of this rib have a tendency to disturb the snap fit connection between the lid and cup.

In operation, the cup is first filled with the beverage which, for the purposes of this specification, may be taken as coffee from which steam emanates. The lid is applied to the upper end of the filled container and with both of the drinking and relief valves closed, may be carried about from place to place without danger of leaking the contents thereof. When a person is desirous of drinking the hot coffee, he places his lips against that portion of the periphery of the lid in close proximity to the drinking valve opening and exerts a downward pressure on the central portion of the straight rib. This results in opening of the relief valve opening to permit steam to escape from the interior of the cup with the lid thereon and opening of the drinking opening to enable the user to cause the coffee to pass therethrough under gravity action caused by tilting of the cup.

For a full and more complete understanding of the invention, reference may be had to the following description and accompanying drawing, wherein.

DESCRIPTION OF A PREFERRED EMBODIMENT

Figure 1:
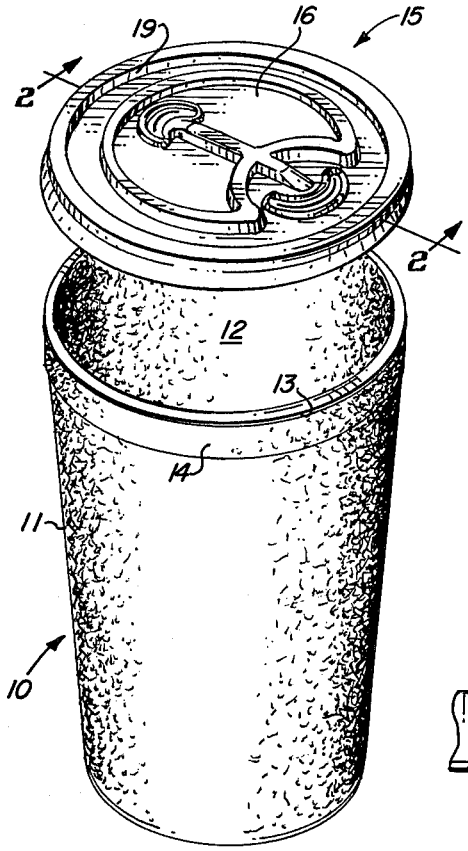
FIG. 1 is a perspective illustrating the drinking cup and lid in exploded relation.

Referring now to the drawing wherein like reference characters denote corresponding parts throughout the several views, and first more particularly to FIG. 1, a drinking cup is therein depicted and represented in its entirety by the reference character 10. It is of polystyrene and is made from polystyrene beads which are expanded and molded by heat. This material has good heat-insulating properties which are useful and desirable for containing either hot or cold beverages. The drinking cup 10 has a frusto-conical wall 11 which presents an open top 12 defined by a peripheral bead 13 which projects slightly beyond the outer surface of wall 11. Immediately below this bead 13 is an annular band 14 which in effect provides a thicker material for this portion of the cup.

A lid is designated in its entirety at 15. It comprises a circular top wall 16 and an annular skirt 17 depending therefrom. Top wall 16 is formed with an annular groove 18 which is defined by an inclined wall 19 that upstands from top wall 16, the upper portion of skirt 17 and a ring-like flat wall 20. This groove 18 receives bead 13 when the parts are assembled to provide a snap connection which renders lid 15 detachable from cup 10.

Figure 3:
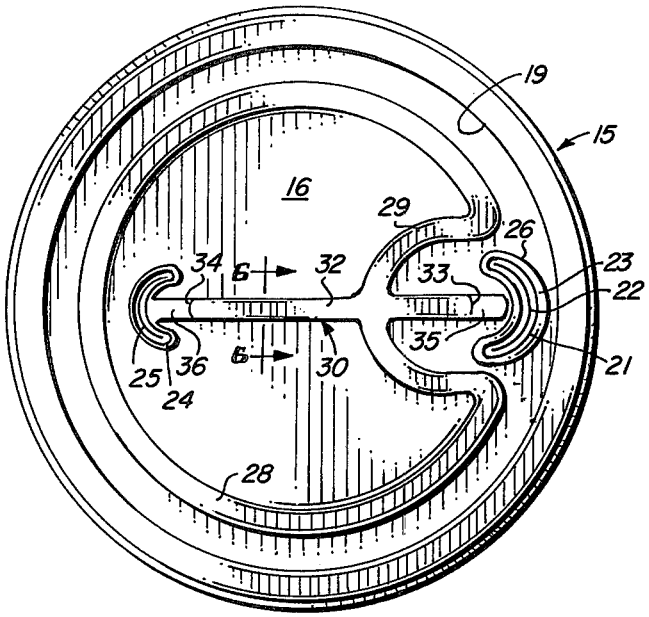
FIG. 3 is a top plan view of the lid.
Figure 5:
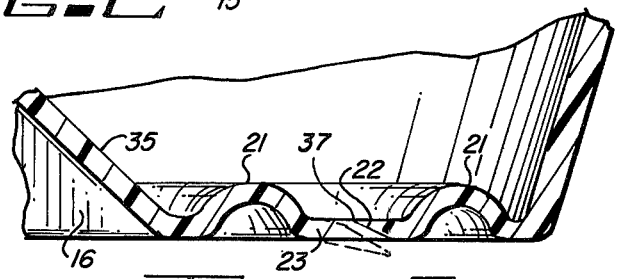
FIG. 5 is another enlarged detail section through the lid taken in the area within the broken-line circle 5 of FIG. 2.

Referring now more particularly to FIGS. 3 and 5, top wall 16 is formed with a pair of spaced-apart arcuate ribs 21 which project upwardly from wall 16. In the space between these ribs 21, a portion of a frusto-conical slit 22 is cut; thus it presents a portion of a frusto-conical surface which defines a drinking valve opening 37 and a valve member 23 which normally closes the drinking opening 37.

At a location diametrically opposite to slit 22, lid 16 is formed with an arcuate rib 24 which is of a smaller radius than the ribs 21 and is spaced from the periphery of rib 16 a distance greater than the spacing of the slit 22 from the periphery. Immediately adjacent to rib 24 and on the inner side thereof is a straight slit 25 that is arcuate in shape, conforming to the shape of the rib 24. This slit 25 provides a relief opening 26 which is normally closed by the valve member 27 which is formed integrally with lid 16. With the top wall 16 free of pressure thereon, this valve member 27 closes the relief opening 26. However, when it is depressed, the relief opening 26 is opened.

Figure 6:
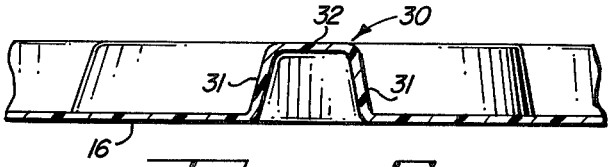
FIG. 6 is an enlarged detail section taken on the plane of the line 6—6 of FIG. 3.
Figure 2:
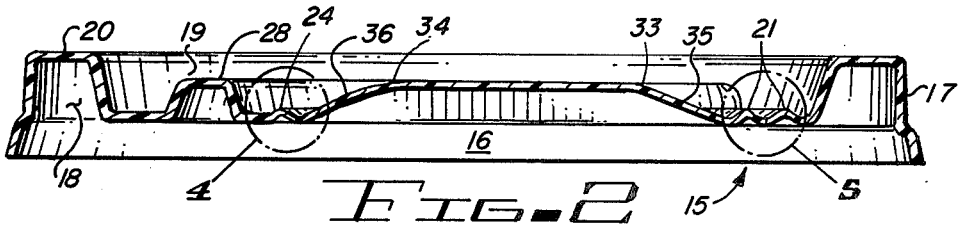
FIG. 2 is a diagrammatic section through the lid taken about on the plane represented by the line 2—2 of FIG. 1.
Figure 4:
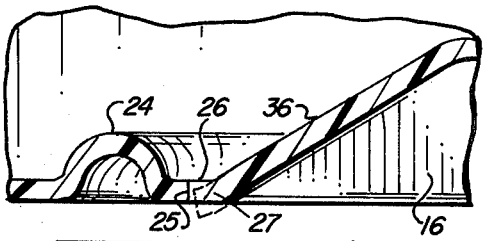
FIG. 4 is an enlarged detail section through that portion of the lid enclosed by the broken-line circle of FIG. 4.

Referring now more particularly to FIGS. 2 and 3, a reinforcing rib 28 is of generally circular shape and spaced inwardly from the periphery of the top wall. This rib 28 projects upwardly from the top wall but its circular shape is interrupted by the U-shaped portion 29 which accommodates the ribs 21 between which the slot 22 is formed and the valve member 23. A straight rib 30 presents side walls 31 and top wall 32. It projects upwardly from the top wall 16 as depicted in FIG. 6. Rib 30 is of gradually diminishing height from line 33 to rib 21, as illustrated in FIGS. 2, 3 and 5, while the rib 30 also diminishes in height from line 34 to relief opening 26. This diminishing in height of rib 30 presents inclined end portions 35 and 36. Lid 15 is molded from a polystyrene sheet material and is fairly thin whereby it is flexible and elastic to a high degree.

Operation

While the manner of using and mode of operation of the subject disposable drinking cup and valved lid of this invention are believed to be obvious from the illustrations of the drawings and description of parts set forth above, it is briefly described as follows:

A beverage such as coffee is first poured into cup 10 through the open top 12. Lid 15 is then applied thereto by exerting sufficient downward pressure on the lid to force groove 18 over bead 13 to establish a fluid-tight seal and snap-on connection which permits removal of the lid from the cup.

Either steam from a hot beverage or gas from a carbonated beverage will collect beneath the lid. However, the pressure of such steam or gas against valve member 23 will securely hold it in fluid-tight relation relative to the inclined slit wall 22. The straight cut of slit 25 might permit of a small amount of such steam or gas, which would not be objectionable and in fact might prove to be desirable in that it would inhibit the creation of sufficient pressure to impair the snap fit.

With the cup filled and the lid thereon, it may be carried about from place to place with the contents of the cup insulated against heat exchange between ambient temperature and that of the contents of the cup.

When a user is desirous of drinking from the cup, a downward pressure is applied to the wall 32 of rib 30. This downward pressure will cause a downward deflection of valve member 27 relative to relief opening 26 to open this opening and permit the escape of gas or steam therethrough. At the same time, this downward pressure will cause valve member 23 to be deflected downwardly and open drinking opening 37. The user may then tilt the cup to cause the contents thereof to flow through this drinking opening and into his mouth, the lips of which are placed about the peripheral portion of lid 15 adjacent to slit 22. In the absence of rib 30, downward pressure on top wall 16 might exhibit a tendency to deflect portions of the lid 16 so as to disturb the snap connection between the lid and the cup. However, with rib 30 included, any deflection of top wall 16 is accommodated by side walls 31 of rib 30.

The area between the ribs 21 is of the utmost importance. Thus, should any of the contents of cup 10 seep upwardly through slit 22, it will collect in the recess defined by ribs 21. Such seepage would be attended by the creation of a natural vacuum which draws the liquid back into the cup.

While a preferred specific embodiment of the invention is hereinbefore set forth, it is to be clearly understood that the invention is not to be limited to the exact constructions, mechanisms and materials illustrated and described because various modifications of these details may be provided in putting the invention into practice.

What is claimed is:

1. In a disposable drinking cup with a valved, circular lid including a frusto-conical cup having an open top and of a good heat-insulating material, said lid comprising a top wall having a periphery with a skirt depending therefrom, said lid being detachably mounted on said open top by a snap connection including an annular groove in the lid immediately adjacent to the periphery of the lid, said lid being of a flexible elastic plastic having heat-insulating properties, the improvement to the lid comprising:

(a) a first arcuate slit, the concave side of said first arcuate slit opening radially inwardly toward the center of said circular lid, the first slit extending through said top wall from its top surface to its under surface in close proximity to the periphery of said circular lid, said slit providing a drinking opening when the material of the top wall adjacent said concave side is depressed, said material providing a valve member which normally resiliently closes said drinking opening;

(b) a second arcuate slit, the concave side of said second arcuate slit opening radially inwardly toward the center of said circular lid, the second slit extending through said top wall from its top surface to its under surface in a position diametrically opposite the first slit providing the drinking opening, and which defines a relief opening when the material of the top wall adjacent said concave side of the second slit is depressed, said material providing a relief valve which normally resiliently closes said relief opening;

(c) a straight reinforcing rib upstanding from said top wall and extending between said valve member and said relief valve with one end portion of said rib terminating within the area defined and bordered by said first arcuate slit and with the remaining end portion of said rib terminating within the area defined and bordered by said second arcuate slit, the area defined and bordered by the first and second arcuate slits being bounded by an imaginary straight line connecting the end points of the arcs of the respective first and second arcuate slits whereby downward pressure on said rib causes deflection of said top wall to move said valve member and said relief valve, opening said drinking opening and said relief opening; and (d) a generally circular reinforcing rib upstanding from said top wall and radially inwardly of and concentric with said periphery and spaced radially outwardly of said relief opening with the generally circular formation of said reinforcing rib being interrupted by a U-shaped formation, the open end of said U-shaped formation being directed radially outwardly toward said first arcuate slit, the interposition of said U-shaped formation preventing the otherwise intersection of said generally circular reinforcing rib and said first arcuate slit.

2. The disposable drinking cup and valved lid of claim 1 in which said top wall of said lid is formed with an arcuate rib upstanding therefrom which generally encompasses and conforms to the shape of said arcuate slit which defines the drinking opening.

3. The disposable drinking cup and valved lid of claim 2 in which the top wall of the lid is formed with an arcuate rib that upstands from the top wall about the slit which defines the relief opening.

4. The disposable drinking cup and valved lid of claim 1 or claim 2 in which said top wall of said lid is formed with an arcuate rib upstanding therefrom which generally encompasses and conforms to the shape of said arcuate slit which defines said relief opening.

* * * * *